US009307851B1

(12) United States Patent
Rhodes

(10) Patent No.: US 9,307,851 B1
(45) Date of Patent: Apr. 12, 2016

(54) DRINKING STRAW AND CLOSURE ASSEMBLY

(71) Applicant: Ashley Monique Rhodes, Palm Springs, FL (US)

(72) Inventor: Ashley Monique Rhodes, Palm Springs, FL (US)

( * ) Notice: Subject to any disclaimer, the term of this patent is extended or adjusted under 35 U.S.C. 154(b) by 0 days.

(21) Appl. No.: 14/282,008

(22) Filed: May 20, 2014

(51) Int. Cl.
*A47G 19/22* (2006.01)
*A47G 21/18* (2006.01)

(52) U.S. Cl.
CPC ..... *A47G 19/2222* (2013.01); *A47G 19/2272* (2013.01); *A47G 21/18* (2013.01)

(58) Field of Classification Search
CPC ..... B65D 2231/022; B65D 2517/0049; B65D 47/265; A47G 19/2222; A47G 21/18; A47G 19/2272
USPC ..... 220/253, 254.4, 820, 821, 705, 709; 215/388; 222/557
See application file for complete search history.

(56) References Cited

U.S. PATENT DOCUMENTS

| | | | | |
|---|---|---|---|---|
| 749,592 | A * | 1/1904 | Treen | 126/389.1 |
| 1,020,487 | A * | 3/1912 | Febert | 220/254.4 |
| 3,169,679 | A * | 2/1965 | Hunter | 222/484 |
| 4,402,433 | A * | 9/1983 | Webinger | 222/485 |
| 4,606,893 | A * | 8/1986 | Sangster | 422/265 |
| 5,520,307 | A * | 5/1996 | Miller et al. | 221/2 |
| 5,947,171 | A * | 9/1999 | Woodruff | 141/346 |
| 2005/0258382 | A1* | 11/2005 | Yang | 251/7 |
| 2011/0038761 | A1* | 2/2011 | Saleh et al. | 422/124 |
| 2013/0248529 | A1* | 9/2013 | Vogel et al. | 220/212.5 |

* cited by examiner

*Primary Examiner* — Fenn Mathew
*Assistant Examiner* — James N Smalley
(74) *Attorney, Agent, or Firm* — Glenn E. Gold; Gold & Rizvi, P.A.

(57) ABSTRACT

A drinking straw and closure assembly for use with a container includes a straw element having an outer diameter. A decorative assembly includes a decorative element secured to an attachment sleeve. The attachment sleeve has an inner diameter adapted to fit over the outer diameter of the straw element. A straw support member is adapted for engagement with the straw element and with the container. A rotary closure member is adapted for engagement with the straw element and with the container.

14 Claims, 13 Drawing Sheets

DRINKING STRAW AND CLOSURE ASSEMBLY

FIELD OF THE INVENTION

The present invention relates to a beverage container straw and lid closure assembly. More particularly, the invention pertains to a decorative drinking straw for so-called bubble tea drinks, including decorative elements overlaying part of the straw exterior and an integral straw flange positioned below the decorative elements, wherein the flange is uniquely constructed to releasably engage a container lid while preventing the decorative elements, or portions of the decorative elements, from inadvertently falling into the beverage.

BACKGROUND OF THE INVENTION

Although the origins of the drinking straw are lost to history, their earliest documented use is found in Sumer, dating from circa 3000 B.C. Ancient clay tablets depict Sumerians using narrow tubes to drink beer from a jar, and archaeologists have recovered "straws" in the form of golden tubes adorned with precious stones dating from the same era. Furthermore, it is known that in Argentina natives used drinking straws for several thousand years. Their simple wooden designs were subsequently adapted in metallic devices referred to as "bombilla," which served as both straw and sieve for drinking tea.

The intervening centuries saw the use of a rye grass straw become common. A principal drawback of these natural drinking straws is that they tended to become soggy after very little use. Glass sipping tubes were also known, but their relatively high cost and low durability made them impractical for widespread use. Attempts to develop paper straws were met with varying degrees of success. The development of the modern mass-produced drinking straw is widely credited to Marvin G. Stone, with his development of a process for manufacturing wound paper straws.

Stone's invention inspired myriad variations on the mass-produced straw. Bendable paper straws appeared in the late 1930's, followed by plastic straws after World War II. Convoluted "crazy straws," flavored straws, extendable straws, spoon straws and edible straws are just some examples of currently available drinking straws.

It is also known to provide straws with decorative elements. For example, straws have been produced in colors, printed with indicia, and molded with 3-dimensional symbols and images. So-called "party straws" have decorative elements such as artificial flowers and/or costume jewelry secured to an upper end of the straw with adhesives. Such decorative elements are prone to unwanted and unexpected detachment from the straw. This can create a health hazard, particularly when such decorative elements fall into a beverage completely unbeknownst to the beverage drinker.

Large-diameter straws have been provided for use with beverages having high viscosity and/or containing solid or semi-solid particles. One such beverage enjoying widespread popularity is "bubble tea" or "pearl milk tea." Bubble tea has many variations, but is basically a relatively thick fruit or tea-based drink containing tapioca pearls. Bubble tea is typically consumed by drinking the liquid, along with some of the tapioca pearls, through a large-diameter straw. A spoon is sometimes used to eat the tapioca pearls either during or after drinking the beverage. Accordingly, conventional bubble tea cup lids have hemispherical geometry with a relatively large central opening through which a spoon can be inserted into the contained beverage.

There is a well-recognized commercial market for the sale of high-end decorative straws for bubble tea drinks, particularly for reusable decorative straws incorporating faux jewels, pearls and other such decorative components. However, an obstacle to creating such decorative straws is the need to adhere the components directly to the limited exterior surface of the straw using conventional chemical adhesives. The potential for these decorative components to become detached from the exterior straw surface and fall into the beverage, through the opening in the drink lid, presents a real health hazard.

Accordingly, there remains a need in the art for a decorative straw and closure assembly that overcomes these and other drawbacks, disadvantages and limitations of the known art.

SUMMARY OF THE INVENTION

In accordance with an implementation of the invention, a beverage container drinking straw and closure assembly, is provided including:

a hollow beverage drinking straw defined by an upper edge, a lower edge, an interior surface and an exterior surface, the exterior surface defining a straw exterior diameter;

a sleeve defined by an upper edge, a lower edge, an interior surface and an exterior surface, the interior surface defining a sleeve inner diameter;

a rotary closure member having hub extending outward from a rotary closure member central hub aperture, the hub having an upper surface, a lower surface and terminating at a hub peripheral edge, a plurality of hub radial closure leaves extending outward from said rotary closure member, each radial closure leaf terminating at an engagement flange, the respective closure leaf engagement flanges extending outward beyond said hub peripheral edge; and a drinking straw support member having a central hub portion extending outwardly from a central drinking straw hub portion aperture, and a plurality of spaced-apart integral radial support portions extending outwardly from said hub portion and terminating at respective radial support portion engagement flanges.

In an aspect of the invention, the assembly decorative sleeve element easily slidably received upon and removed from the drinking straw, thereby enabling a user to the ability to interchange decorative elements.

In another aspect of the invention, the decorative sleeve is constructed from a resilient body providing a snug frictional fit about the exterior of the straw to prevent unwanted slipping of the sleeve about the straw.

In another aspect, the hub of the rotary closure member effectively prevents components of the decorative assembly from inadvertently falling into the beverage.

In another aspect, the radial closure leaves cooperate with the radial support portions of the drinking straw support member to facilitate selective access to the interior of the beverage container.

In another aspect, the straw can optionally be provided with an integral stop to limit sliding movement of the decorative body toward the upper end of the straw.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
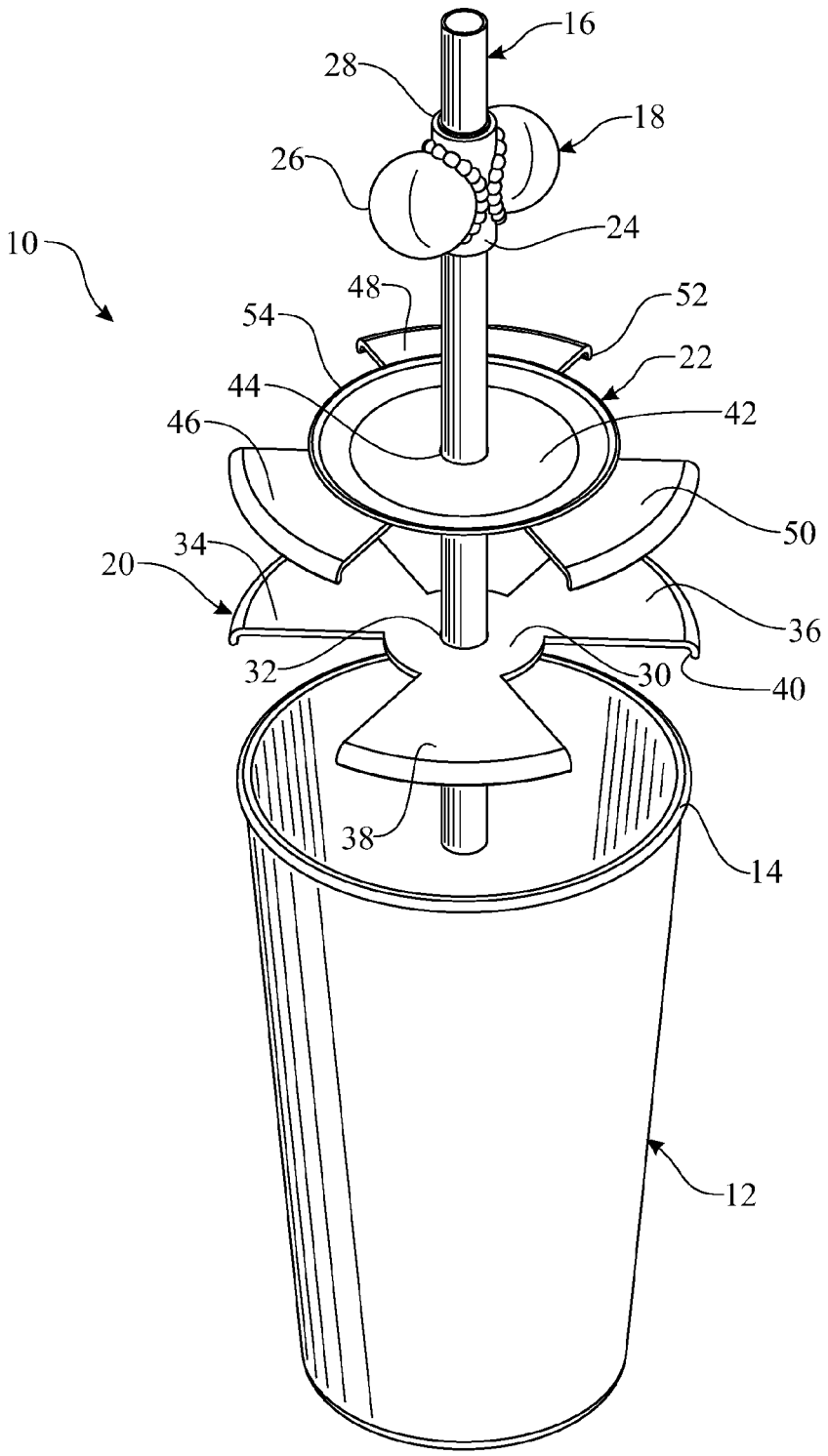
FIG. 1 presents an isometric, exploded assembly view, in accordance with a first exemplary implementation of the beverage container drinking straw and lid closure assembly of the present invention.
Figure 2:
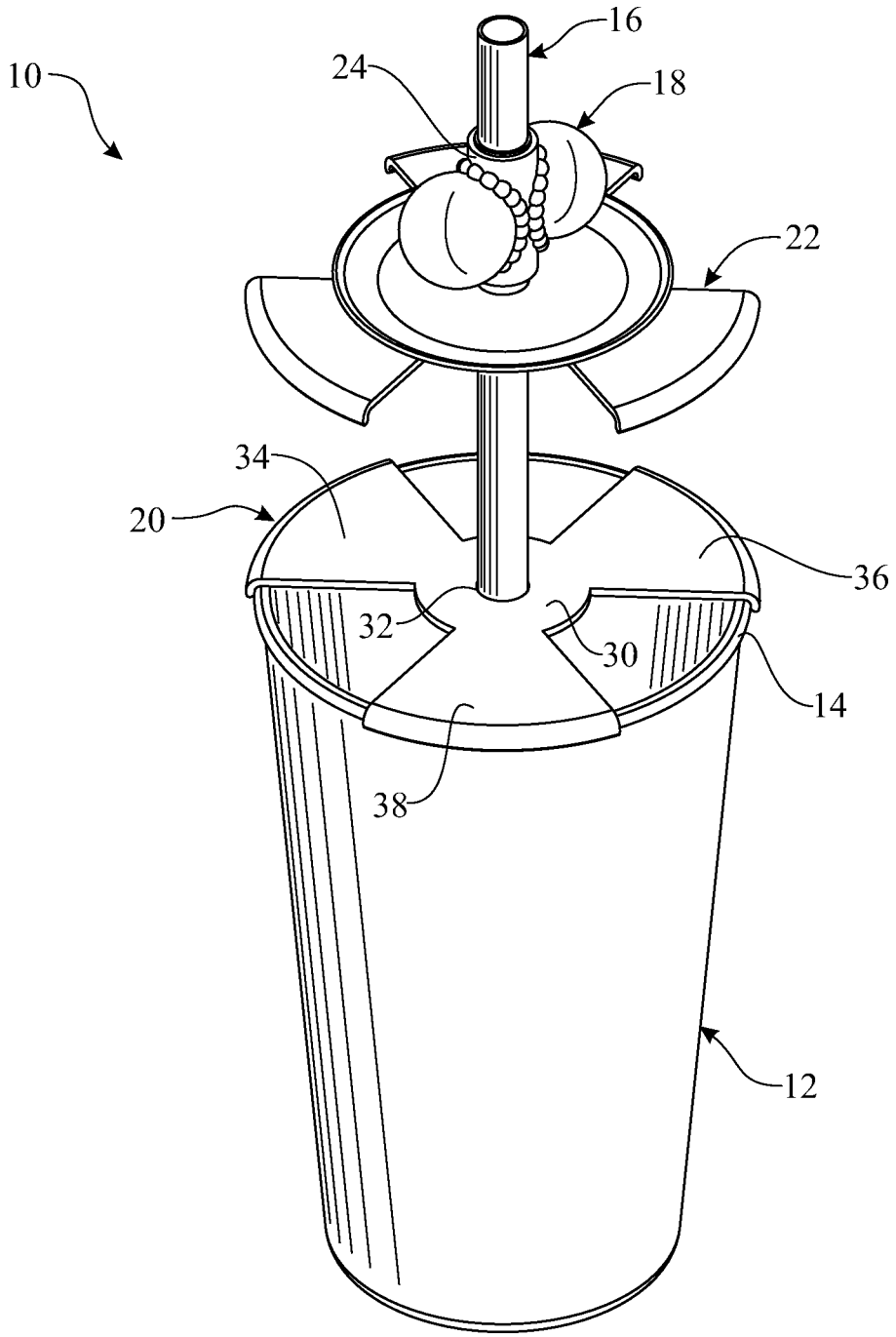
FIG. 2 presents an isometric, exploded assembly elevation view of the drinking straw and closure assembly originally introduced in FIG. 1, illustrated in a partially installed configuration.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-14, various implementations of the present invention are depicted. Referring initially to FIGS. 1-8, a first exemplary implementation of a beverage drinking straw and container lid closure assembly is shown generally by reference numeral 10. In a preferred implementation, the assembly includes a beverage container 12, a straw 16, a decorative assembly 18, a rotary closure member 22 having a central hub 42 and a plurality of outwardly extending radial closure leave 46, 48 and 50, and a straw support member 20. Significantly, the decorative assembly 18 has an interior surface defining a central bore corresponding in diameter with the diameter of a rotary closure member central aperture 44 and the diameter of a straw support member central aperture 32, wherein the corresponding diameters are approximately the same as the exterior diameter of the straw 16, and the central bore of the decorative assembly 18, the central aperture of the rotary closure member and the straw support member central bore are centrally aligned with one another when the assembly 10 is in a fully assembled state. In this manner, the drinking straw 16 is maintained in a vertical orientation when inserted therethrough and into beverage container 12.

Figure 8:
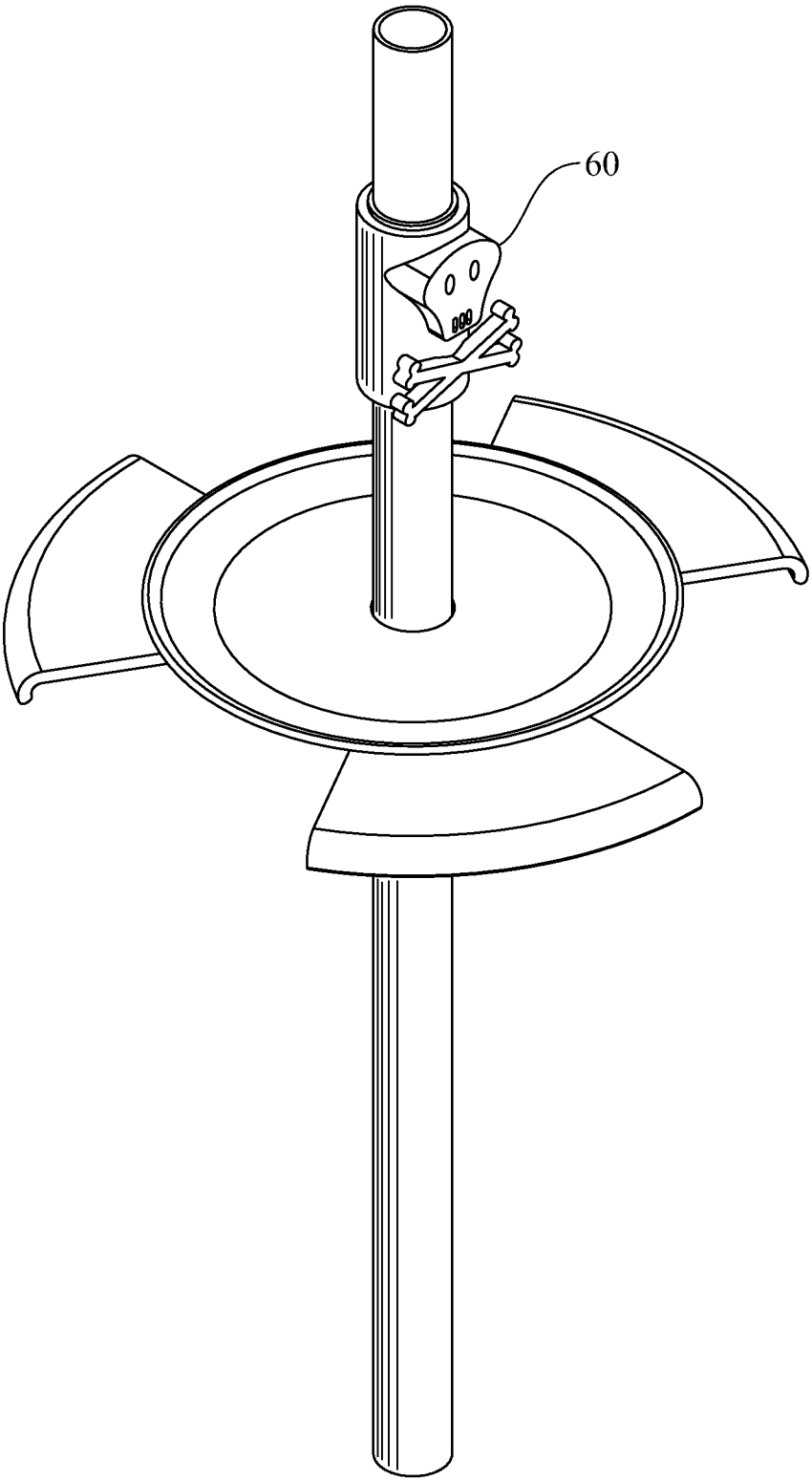
FIG. 8 presents an isometric view of an alternative decorative assembly wherein the sliding sleeve and decorative components are constructed as a single integrally-molded body.

The drinking straw and closure assembly 10 may cooperate with a beverage container, herein illustrated as a drinking cup 12 having an upper rim, or lip, 14. The drinking straw is illustrated having a decorative assembly 18 wherein decorative elements 26 are provided fixedly attached to an attachment sleeve 24, which preferably has a resilient construction, such as, for example, a stretchable rubber. However, as will be apparent to those skilled in the art, attachment sleeve can be constructed using myriad other materials including, for example, a molded polymer. Significantly, in this particular implementation sleeve 24 is preferably particularly sized and shaped to frictionally engage the exterior surface of straw 16. In this manner, decorative assembly can be easily positioned along the length of the straw 16. Optionally, sleeve 24 may be permanently affixed to straw 16 using, for example, a chemical adhesive. Similarly, decorative element 26 can be provided affixed to sleeve 24 using a chemical adhesive. Alternatively, as best illustrated in FIG. 8, a decorative element 60 could be provided integrally molded with sleeve 24. Furthermore, in lieu of using a sleeve 24, decorative elements 26 could be provided directly affixed to straw 16 or integrally molded with straw 16.

Generally, where an attachment sleeve is utilized, the attachment sleeve 24 is provided with an inner diameter that is equal to or slightly greater than an outer diameter of the straw 16. The respective diameters are chosen to provide a secure, sliding friction fit between the attachment sleeve 24 and the straw element 16. The straw element 16 may be provided with a stop flange 28 to limit the length of travel of the attachment sleeve 24 on the straw element 16, thus ensuring desired placement of the decorative element 18. Although integral molding and friction fit are previously set forth as securing methods, it is also contemplated that other suitable securing methods, such as sonic welding, heat welding, or adhesives, may be employed as desired.

The straw element 16 is secured to the container 12 via the straw support element 20. The straw support element 20 includes a hub 30 having a central aperture 32 having a diameter corresponding to the outer diameter of the straw element 16. A plurality of radial support portions 34, 36, and 38 are provided extending radially from the hub 30. Each of the radial support members 34, 36, 38 is selectively secured to the upper rim 14 of the container 12. In the illustrated embodiment, the radial support members 34, 36, 38 are secured to the upper rim 14 of the container 12 by means of engagement flanges 40 that serve to grip the rim 14 of the container 12 in a conventional manner.

The rotary closure member 22 of the drinking straw and closure assembly 10 includes a hub 42 having a central aperture 44 having a diameter corresponding to the outer diameter of the straw element 16. A plurality of radial closure leaves 46, 48, 50 extend radially from the hub 42. Each of the radial closure leaves 46, 48, 50 is selectively secured to the upper rim 14 of the container 12. In the illustrated embodiment, the radial closure leaves 46, 48, 50 are secured to the upper rim 14 of the container 12 by means of engagement flanges 52 that serve to grip the rim 40 of the container 12 in a conventional manner. A gripping flange 54 is provided on the hub 42.

Figure 3:
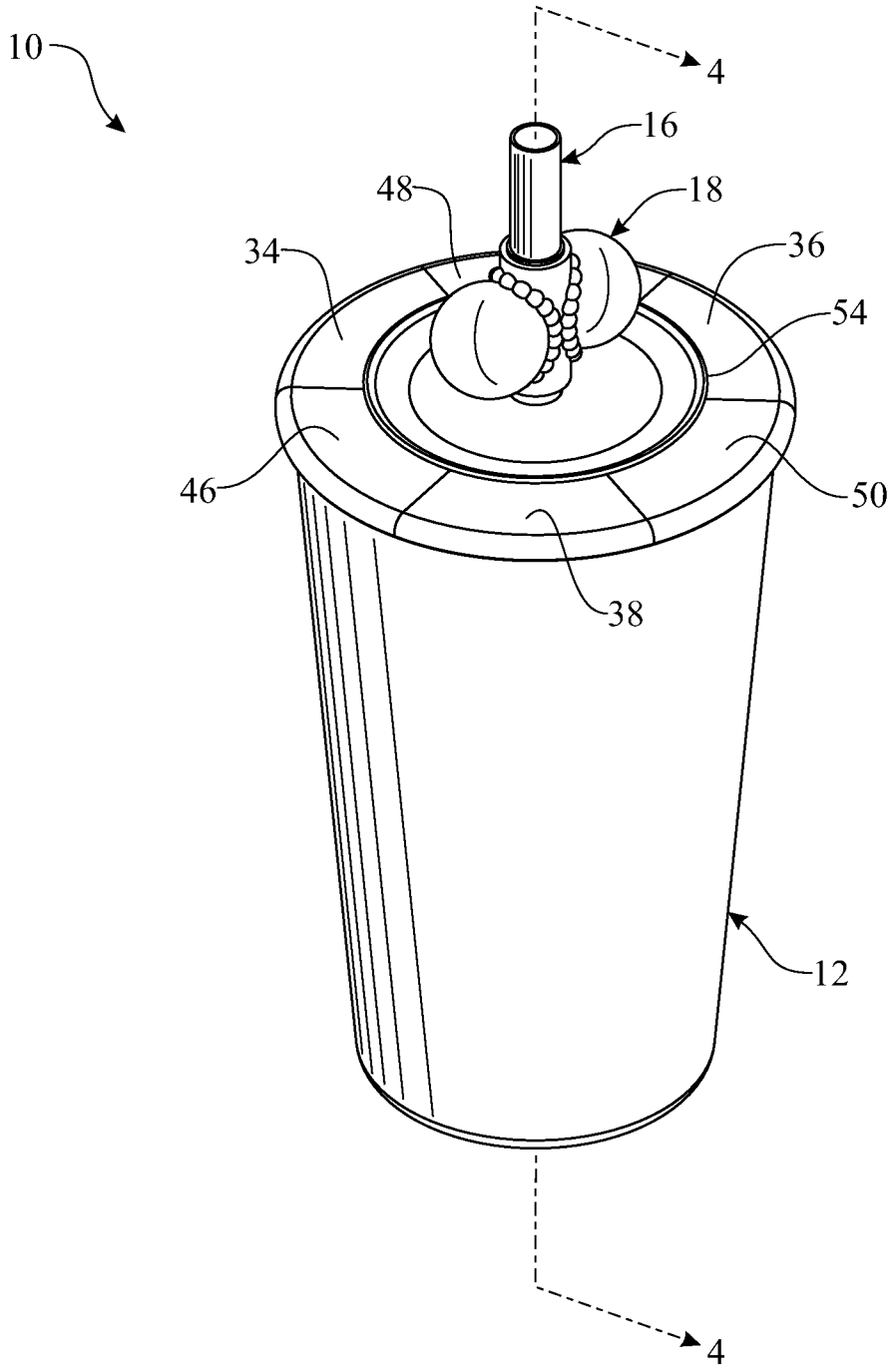
FIG. 3 presents an isometric view of the drinking straw and closure assembly originally introduced in FIG. 1, illustrated in a fully assembled configuration.
Figure 4:
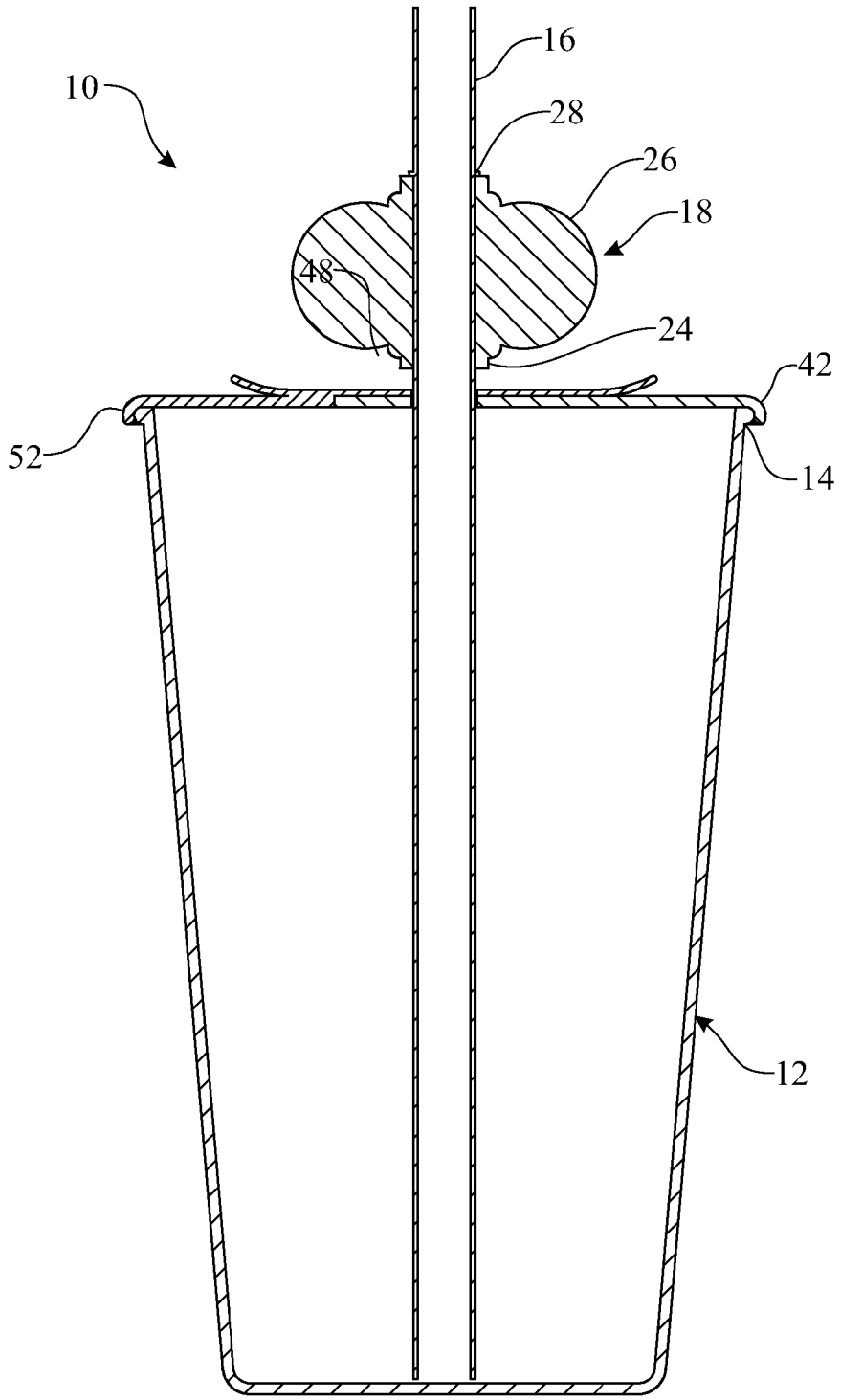
FIG. 4 presents a sectional view taken generally along section lines 4-4 of FIG. 3.
Figure 5:
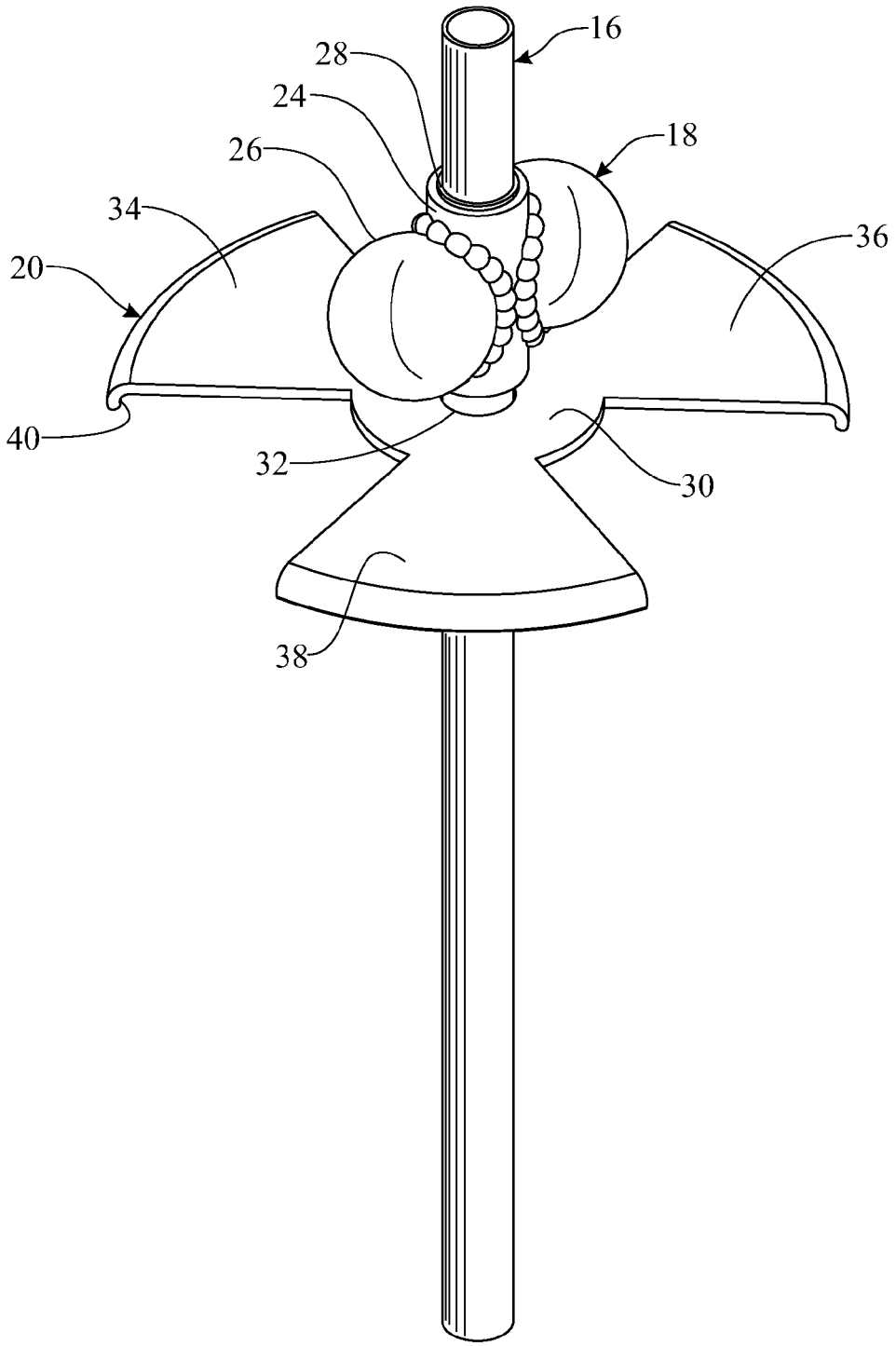
FIG. 5 presents an isometric view of a straw element, decorative assembly and straw support element, in an assembled state.
Figure 6:
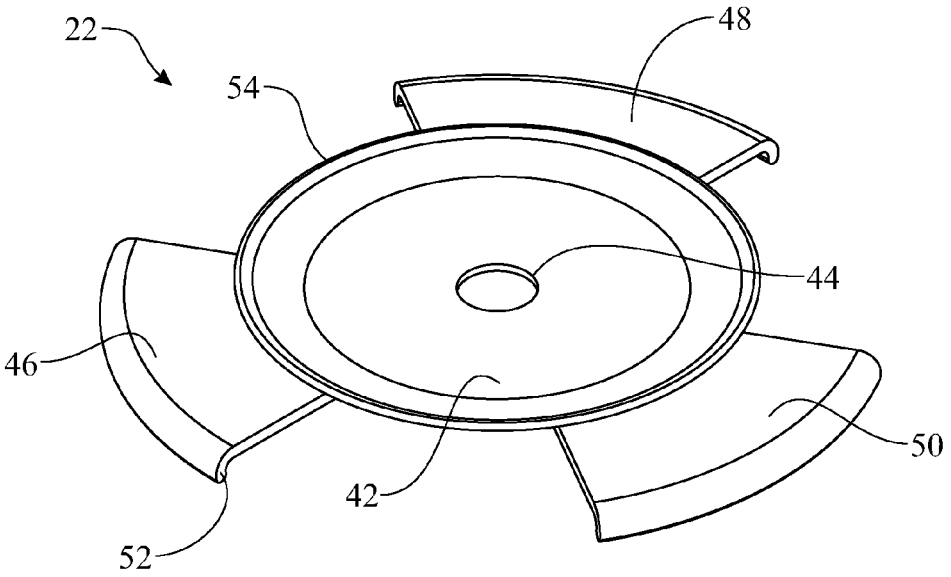
FIG. 6 presents an isometric, top view of a rotary closure element.
Figure 7:
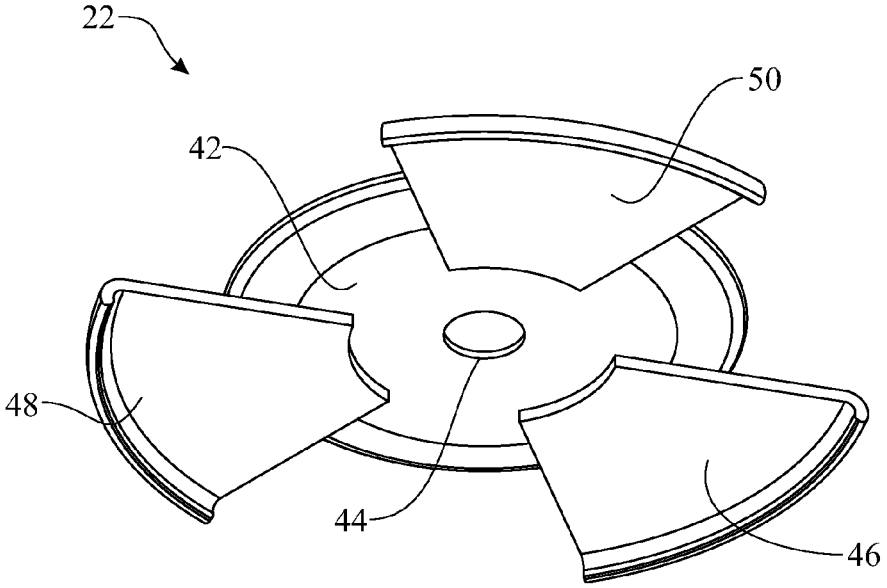
FIG. 7 presents an isometric, bottom view of the rotary closure element in FIG. 6.

The dimensions of the radial closure leaves 46, 48, 50 are provided to be at least the same size as, and preferably slightly larger than, the spaces between the radial support members 34, 36, 38 of the straw support member 20. Thus, when the drinking straw and closure assembly 10 is in its assembled and closed position as shown in FIG. 3, a user of the drinking straw and closure assembly 10 can release the radial closure leaves 46, 48, 50, grasp the gripping flange 54, and rotate the closure member 22 to permit access to the contents of the container 12, for example, with a spoon.

Figure 9:
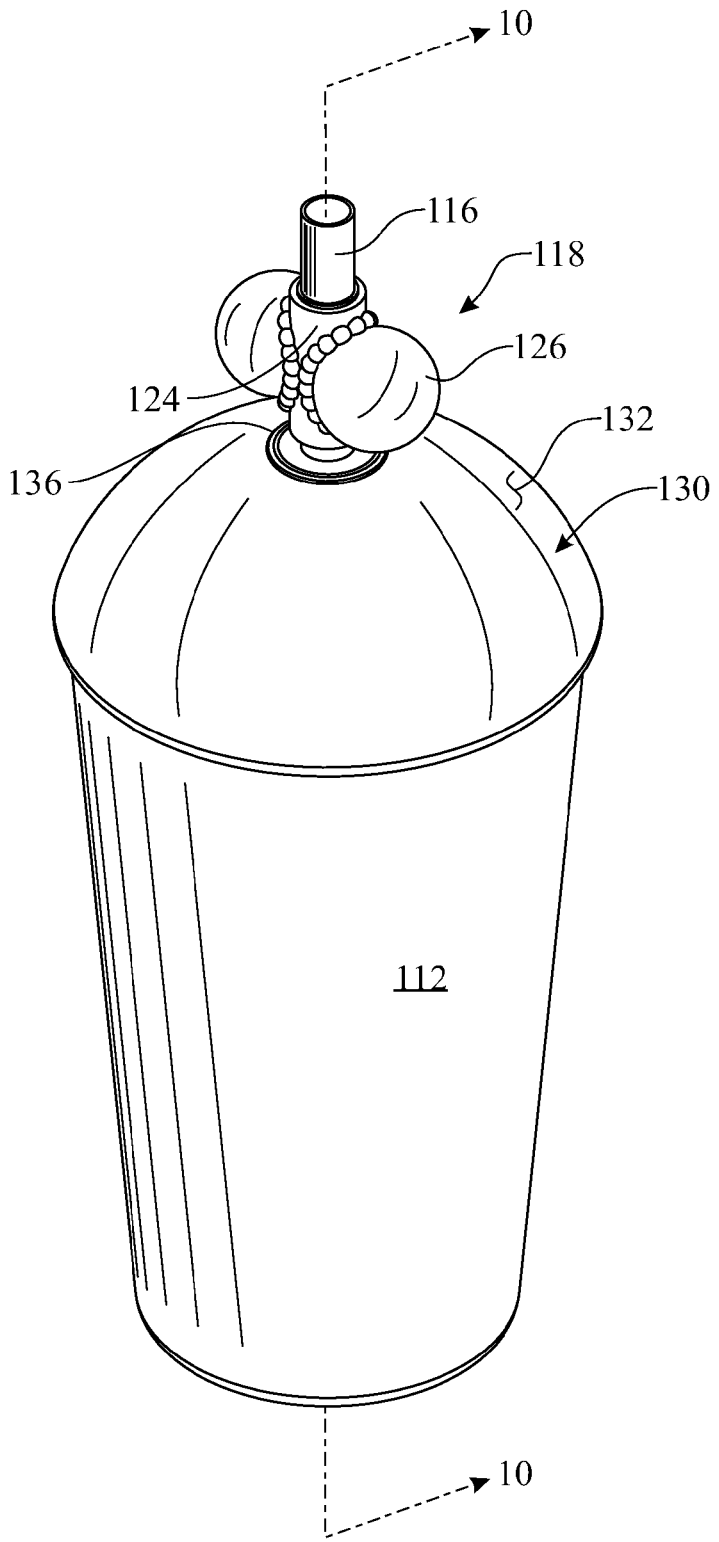
FIG. 9 presents an isometric view of a second exemplary implementation of the present invention in a fully assembled configuration.
Figure 10:
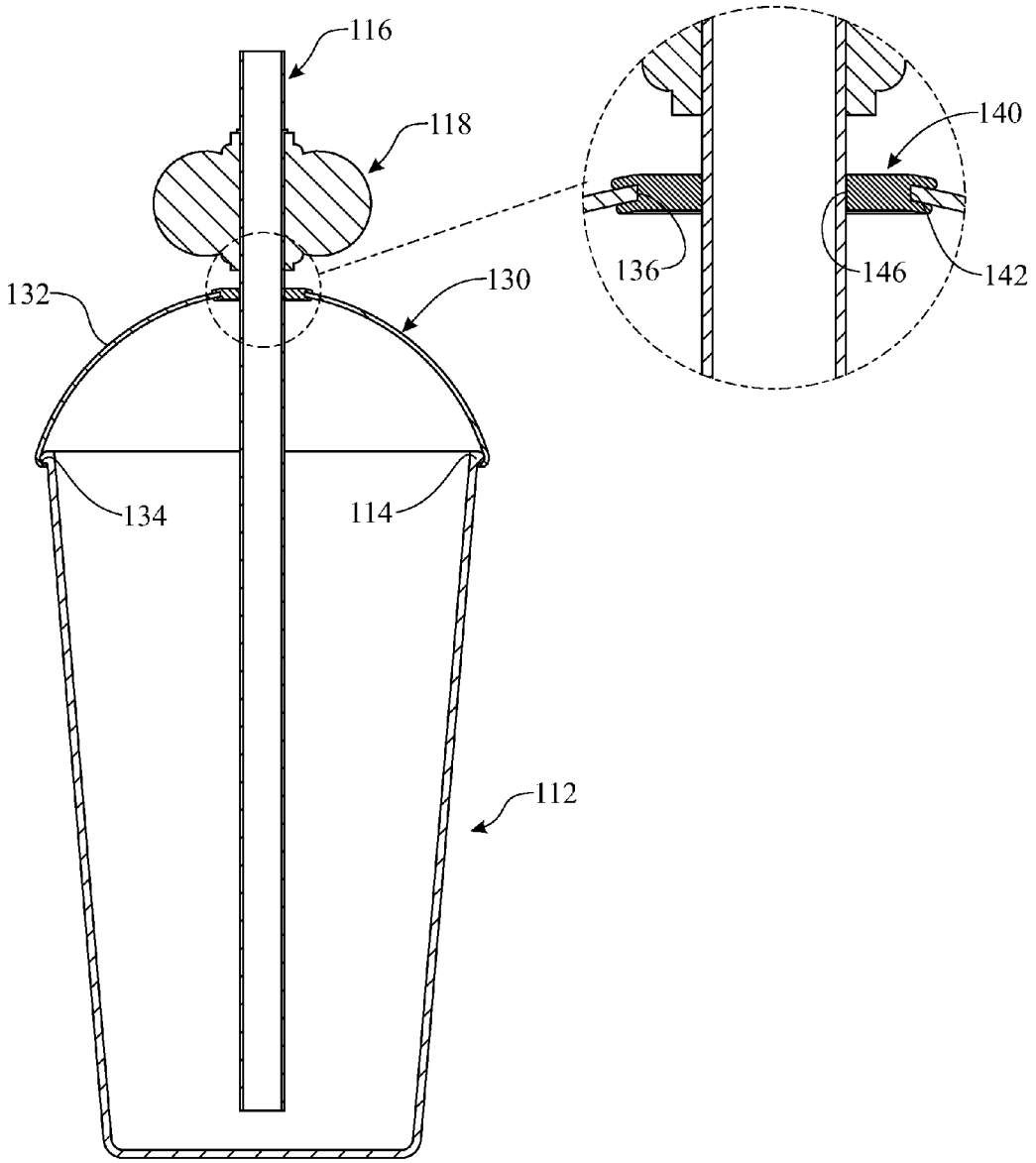
FIG. 10 presents a cross-sectional view taken along section lines 10-10 of FIG. 9.

Referring now particularly to FIGS. 9-10, in an alternative implementation the assembly includes a beverage container 112, drinking straw 116, and a decorative assembly 118, including, for example, decorative elements 126 adhesively secured to a sleeve portion 124. In this implementation a container lid 130, optionally having a convex top 132, includes a central opening defined by edge 136 extending therethrough. A lower perimeter of the lid 130 may be provided having a lid flange 134 configured for being snap-fittingly engaged about container rim lip 114.

Preferably, an annual member 140 is provided having a central opening defined by interior edge 146, sized and shaped for snug frictional engagement with the exterior surface of straw 116. Significantly, annular member 140 is provided having a contiguous external peripheral groove 142, particularly adapted for releasable snap-fitting engagement with beverage central opening edge 136. In this manner, annular member 140 functions to maintain a desirable vertical orientation of straw 116, while closing the gap between the exterior surface of straw 116 and lid central opening edge 146, preventing any loose portions of decorative assembly 118 from inadvertently falling into the beverage container 112. As will be apparent to those skilled in the art, although annular member 140 is shown assembled to a convex-shaped container lid it is adaptable to be used with planar container lid, or any lid geometry having an opening extending therethrough. Furthermore, while the lid opening and annular member are shown having a circular geometry, other geometries could be implemented without departing from the scope of the invention.

Figure 11:
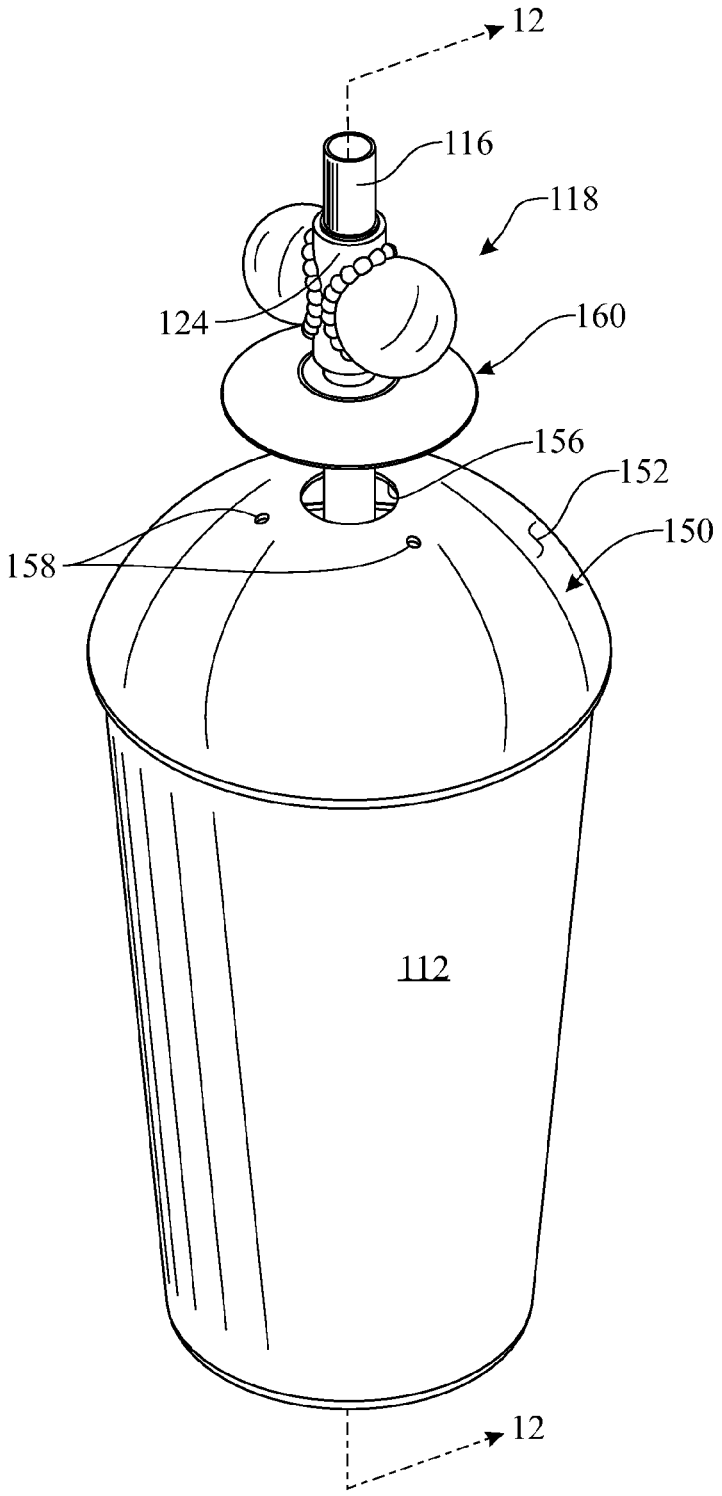
FIG. 11 presents an isometric view of a third exemplary implementation of the present invention in a substantially assembled configuration.
Figure 12:
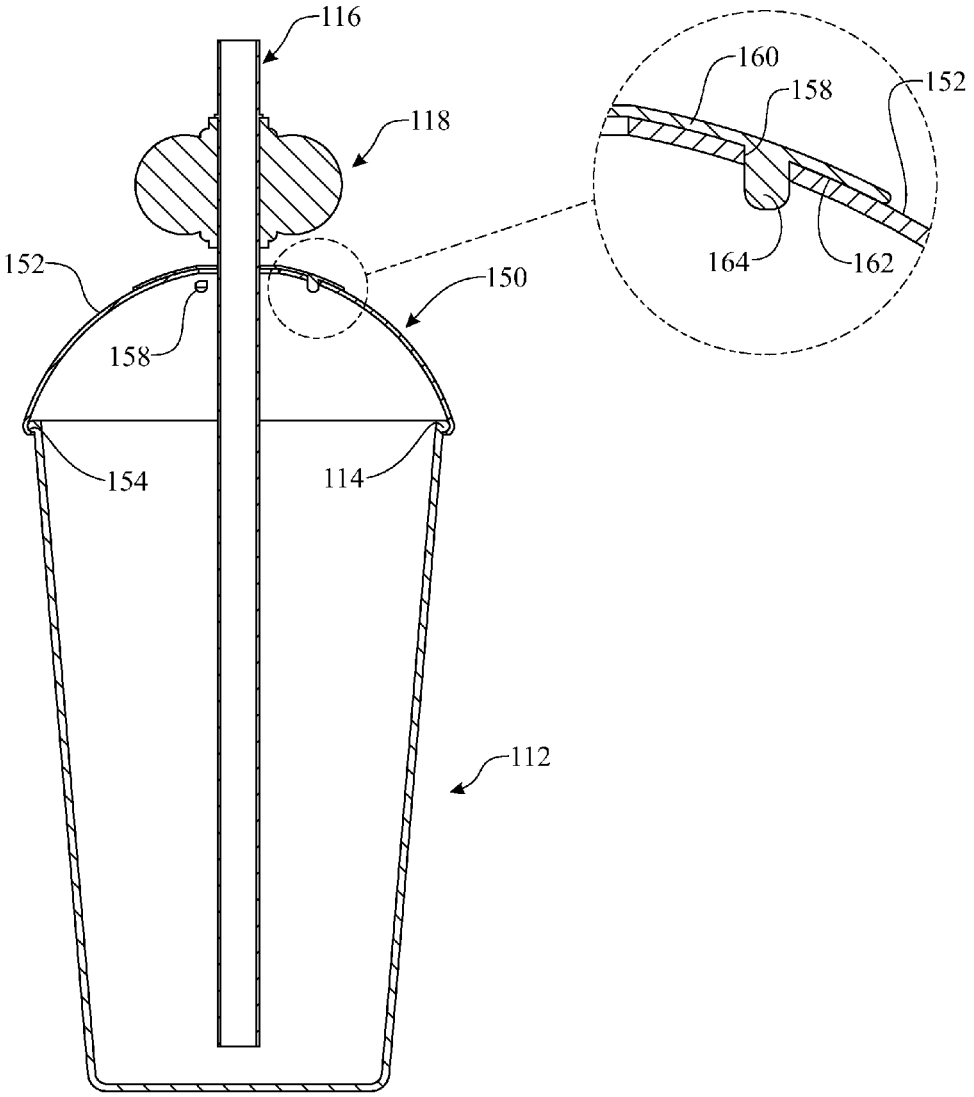
FIG. 12 presents a cross-sectional view taken along section lines 12-12 of FIG. 11.

Referring now particularly to FIGS. 11-12, in an alternative implementation the assembly includes a beverage container 112, drinking straw 116, and a decorative assembly 118, including, for example, decorative elements 126 adhesively secured to a sleeve portion 124. In this implementation a convex container lid 130 may be provided having a central opening defined by edge 156 extending therethrough, as well as a plurality of smaller spaced-apart apertures surrounding the central opening. A lower perimeter of the lid 150 may be provided having a lid flange 154 configured for being snap-fittingly engaged about container rim lip 114.

Preferably, a closure member 160 has a central opening defined by an interior edge sized and shaped for snug frictional engagement with the exterior surface of straw 116. Significantly, closure member 160 preferably has a curvature conforming to the curvature of underlying top 152 of lid 150. Significantly, a plurality of integrally molded spaced-apart nubs 164 projecting downward from closure member 160 are sized, shaped and positioned, for alignment and selective snap-fitting engagement with corresponding apertures 158 provided extending through lid 150. In this manner, with the straw and closure assembly fully assembled, closure member 160 provides a dual function; it maintains straw 116 in a vertical orientation while simultaneously covering lid opening 156, thereby preventing any components of decorative assembly 118 from inadvertently falling into beverage container 112.

Figure 13:
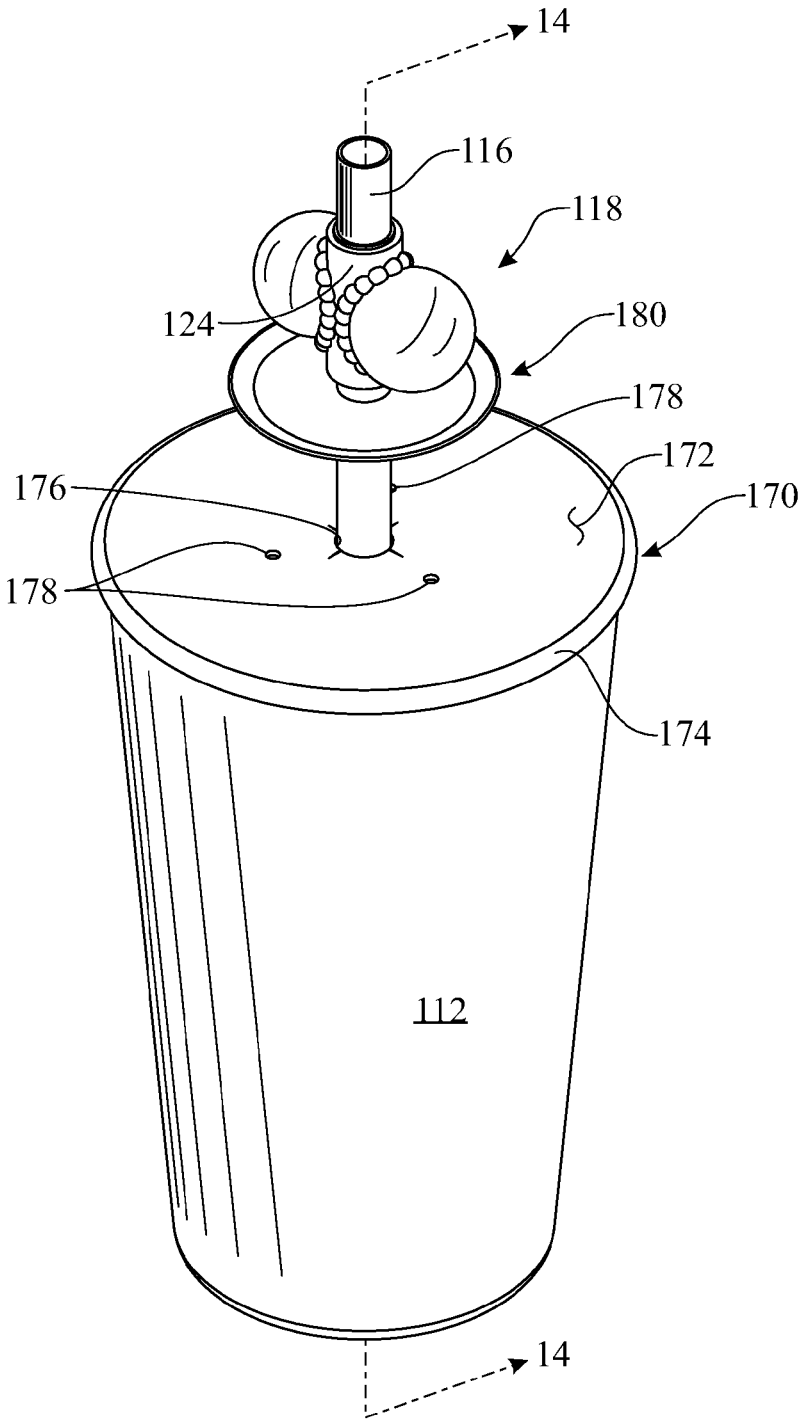
FIG. 13 presents an isometric view of a fourth exemplary implementation of the present invention in a substantially assembled configuration.
Figure 14:
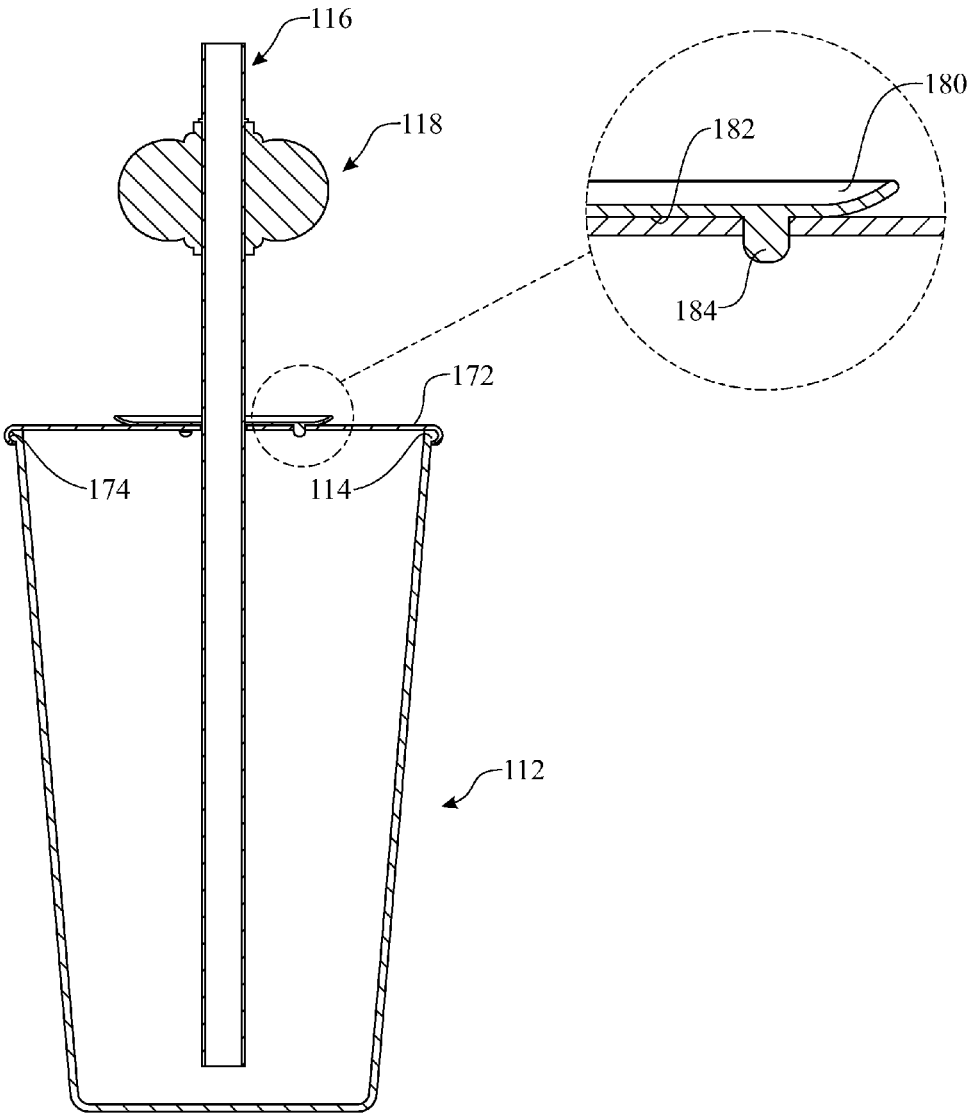
FIG. 14 presents an isometric view taken along section lines 14-14 of FIG. 13.

Referring now to FIGS. 12-13, in a further exemplary implementation the decorative straw and lid closure assembly depicted in FIGS. 10-11 are shown adapted for use with a conventional beverage container having a lid 170 including a planar lid top 172, container rim gripping flange 174 and a straw receiving central aperture 176 sized larger that the diameter of straw 116 and/or having radially-extending slits creating open lid areas surrounding straw 116 when the straw is inserted therethrough.

Preferably, a closure member 180 has a central opening defined by an interior edge sized and shaped for snug frictional engagement with the exterior surface of straw 116. Significantly, closure member 180 preferably has a planar base conforming to the underlying planar top 172 of lid 170. Significantly, a plurality of integrally molded spaced-apart nubs 184 projecting downward from closure member 180 are sized, shaped and positioned, for alignment and selective snap-fitting engagement with corresponding apertures 178 provided extending through lid 170. In this manner, with the straw and closure assembly fully assembled, closure member 180 provides a dual function; it maintains straw 116 in a vertical orientation while simultaneously covering an area surrounding lid opening 176, thereby preventing any components of decorative assembly 118 from inadvertently falling into beverage container 112.

The above-described embodiments are merely exemplary implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A beverage container drinking straw and closure assembly, comprising:

a hollow beverage drinking straw defined by an upper edge, a lower edge, an interior surface and an exterior surface, the exterior surface defining a straw exterior diameter;

a sleeve defined by an upper edge, a lower edge, an interior surface and an exterior surface, the interior surface defining a sleeve inner diameter;

a rotary closure member having a hub extending outward from a rotary closure member central hub aperture, the hub having an upper surface, a lower surface and terminating at a hub peripheral edge, a plurality of hub radial closure leaves extending outward from said rotary closure member, each radial closure leaf terminating at an engagement flange, the respective closure leaf engagement flanges extending outward beyond said hub peripheral edge; and a drinking straw support member having a central hub portion extending outwardly from a drinking straw support member central hub portion aperture, and a plurality of spaced-apart integral radial support portions extending outwardly from said hub portion and terminating at respective radial support portion engagement flanges.

2. The beverage container drinking straw and closure assembly as recited in claim 1, further comprising a beverage container having an upper lip, wherein each rotary closure member hub radial leaf engagement flange and each drinking straw support member radial support portion engagement flange is configured for snap-fit engagement with said beverage container upper lip.

3. The beverage container drinking straw and closure assembly as recited in claim 2, wherein said rotary closure member central hub aperture and said drinking straw support member central hub portion aperture are aligned with one another and have respective diameters corresponding to said straw exterior diameter so as to enable assembly of said rotary closure member and said drinking straw support member about said hollow beverage drinking straw and thereby enable said snap-fit engagement of said flanges of said rotary closure member and said drinking straw support member with said beverage container upper lip.

4. The beverage container drinking straw and closure assembly as recited in claim 2, wherein said radial support portions of said drinking straw support member define spaces therebetween into which said hub radial closure leaves of said rotary closure member fit so as to enable said rotary closure member and said drinking straw support member to be provided in an assembled closed position on a beverage container.

5. The beverage container drinking straw and closure assembly as recited in claim 4, wherein said hub of said rotary closure member has a gripping flange provided on said hub peripheral edge for a user to grasp in order to rotate said rotary closure member relative to said drinking straw support member so as to permit access through said spaces between said radial support portions of said drinking straw support member to contents of the beverage container.

6. The beverage container drinking straw and closure assembly as recited in claim 1, further comprising at least one decorative element provide on said sleeve.

7. The beverage container drinking straw and closure assembly as recited in claim 1 wherein said interior surface of said sleeve is provided in frictional engagement with said exterior surface of said hollow beverage drinking straw.

8. The beverage container drinking straw and closure assembly as recited in claim 1 wherein said sleeve integrally molded with said hollow beverage drinking straw.

9. The beverage container drinking straw and closure assembly as recited in claim 1, wherein said sleeve is positioned about and at a desired placement along said straw.

10. The beverage container drinking straw and closure assembly as recited in claim 9, further comprising at least one decorative element provided on said sleeve.

11. The beverage container drinking straw and closure assembly as recited in claim 10, wherein said straw element is provided with a stop flange so as to ensure said at least one decorative element on said sleeve is positioned at the desired placement along the straw.

12. The beverage container drinking straw and closure assembly as recited in claim 1, wherein said rotary closure member central hub aperture and said drinking straw support member central hub portion aperture are aligned with one another and have respective diameters corresponding to said straw exterior diameter so as to enable assembly of said rotary closure member and said drinking straw support member about said hollow beverage drinking straw.

13. The beverage container drinking straw and closure assembly as recited in claim 1, wherein said radial support portions of said drinking straw support member define spaces therebetween into which said hub radial closure leaves of said rotary closure member fit so as to enable said rotary closure member and said drinking straw support member to be provided in an assembled closed position on a beverage container.

14. The beverage container drinking straw and closure assembly as recited in claim 13, wherein said hub of said rotary closure member has a gripping flange provided on said hub peripheral edge for a user to grasp in order to rotate said rotary closure member relative to said drinking straw support member so as to permit access through said spaces between said radial support portions of said drinking straw support member to contents of the beverage container.

* * * * *